US006512213B2

(12) United States Patent
Choi

(10) Patent No.: US 6,512,213 B2
(45) **Date of Patent: *Jan. 28, 2003**

(54) DEVICE FOR LINEARLY MOVING TRAY IN MICROWAVE OVEN

(75) Inventor: Seong-soo Choi, Changwon Gyeongnam (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 09/988,711

(22) Filed: Nov. 20, 2001

(65) Prior Publication Data

US 2002/0190062 A1 Dec. 19, 2002

(30) Foreign Application Priority Data

Jun. 19, 2001 (KR) ..... 2001-34849
Jun. 19, 2001 (KR) ..... 2001-34850
Jun. 19, 2001 (KR) ..... 2001-34851

(51) Int. Cl.[7] ..... H05B 6/78

(52) U.S. Cl. ..... 219/754; 219/753; 219/762; 126/388

(58) Field of Search ..... 219/753, 754, 219/755, 752, 763, 762; 126/388

(56) References Cited

U.S. PATENT DOCUMENTS 4,121,078 A * 10/1978 Takano et al. ..... 219/754
4,503,307 A 3/1985 Campbell et al.
5,166,486 A * 11/1992 Komatsu et al. ..... 219/754
5,192,842 A * 3/1993 Kim ..... 219/754
5,315,086 A 5/1994 Pressouyre

FOREIGN PATENT DOCUMENTS

JP 52-36347 * 3/1977 ..... 219/754
JP 4-356623 * 12/1992 ..... 219/754

* cited by examiner

*Primary Examiner*—Philip H. Leung
(74) *Attorney, Agent, or Firm*—Fleshner & Kim, LLP

(57) ABSTRACT

A device for linearly reciprocating a tray in the right and left direction within a heating chamber of a microwave oven is provided. The device includes a rectangular tray for loading thereon a foodstuff to be heated within a heating chamber, a driving motor for generating rotational force, a converting means for converting a rotational motion from the driving motor into a linear reciprocating motion of the tray, and a supporting means mounted between a bottom surface of the heating chamber and the tray for supporting the tray so as to linearly reciprocate the tray. The converting means includes a groove formed in the bottom surface of the tray and has a predetermined length, and a rotating member with an eccentric protrusion formed at an eccentric position and inserted into the groove, and the rotating member is rotated by the driving motor so that the tray can be linearly reciprocated depending on the amount of rotation of the eccentric protrusion. Therefore, the space within the heating chamber can be more efficiently and extensively used.

25 Claims, 6 Drawing Sheets

DEVICE FOR LINEARLY MOVING TRAY IN MICROWAVE OVEN

BACKGROUND OF THE INVENTION

1. Field of the Invention

The present invention relates to a device for linearly moving a tray in a microwave oven, and more particularly, to a device for linearly moving a tray in a microwave oven in which the tray for loading a foodstuff to be heated thereon has the same rectangular shape as a bottom surface of a heating chamber of the microwave oven and is linearly moved.

2. Description of the Prior Art

A microwave oven is generally an apparatus for transferring heat to an object (for example, a foodstuff) using a microwave having a constant wavelength. As shown in FIG. 1, the microwave oven includes a heating chamber 2 for heating the foodstuff, and the heating chamber 2 is constructed to be opened and closed by a door 4.

The microwave generated from a magnetron (not shown) is supplied into the heating chamber 2 and causes the foodstuff therein to be heated. At this time, the foodstuff should be uniformly heated by the microwave. However, due to the wavelength characteristic of the microwave, it is difficult to uniformly heat the foodstuff in its stationary state.

Therefore, in order to uniformly heat the foodstuff by using the microwave, a tray 6 for loading the foodstuff thereon should be rotated so that the foodstuff can be uniformly heated by the microwave.

As shown in FIG. 1, the conventional microwave oven constructed such that the foodstuff is heated while the tray 6 for loading the foodstuff thereon is rotated, has the following disadvantages.

Generally, the heating chamber 2 is formed to be rectangular as viewed from above, whereas the tray 6 for loading the foodstuff thereon is constructed to be circular for its rotation. Therefore, it can be seen that an area used for actually heating the foodstuff within the heating chamber 2 corresponds to a circular area occupied by the tray 6. The above means that in view of a structure of the tray mounted within the heating chamber of the conventional microwave oven, there are large dead space that cannot be used for actually heating the foodstuff. That is, when using the structures of the heating chamber and tray of the conventional microwave oven, it can be seen that there is a problem in that the efficiency of using the space within the heating chamber is restricted to a certain limit.

The conventional microwave oven also has the above disadvantages. Furthermore, in a microwave oven that is also used as a hood and is transversely longer, since its transverse length is much longer, dead space that cannot be used for heating the foodstuff becomes much larger.

SUMMARY OF THE INVENTION

The present invention is contemplated to solve the above problems in the prior art. An object of the present invention is to provide a device for linearly moving a tray in a microwave oven, by which the space within a heating chamber of the microwave oven can be efficiently used as a whole.

According to the present invention, since a bottom surface of the heating chamber of the conventional microwave oven is generally formed to be rectangular, the tray is correspondingly formed to be rectangular. Further, the rectangular tray is constructed such that it can be linearly moved in the right and left direction.

According to an aspect of the present invention for achieving the above object, there is provided a device for linearly moving a tray in a microwave oven with a hexahedral heating chamber for heating a foodstuff included therein, comprising: a tray for loading thereon a foodstuff to be heated within the heating chamber; a driving motor for generating rotational force; a converting means for converting a rotational motion from the driving motor into a linear reciprocating motion of the tray; and a supporting means mounted between a bottom surface of the heating chamber and the tray for supporting the tray so as to linearly reciprocate the tray.

According to an embodiment of the converting means of the present invention, the converting means comprises a groove formed in the bottom surface of the tray and having a predetermined length in the fore and aft direction, and a rotating member with an eccentric protrusion formed at an eccentric position and inserted into the groove, and the rotating member is rotated by the driving motor so that the tray can be linearly reciprocated in the right and left direction depending on the amount of rotation of the eccentric protrusion.

According to an embodiment of the device of the present invention, the device further comprises a bearing member fitted around the eccentric protrusion for coming into rolling contact with an inner wall of the groove.

According to an embodiment of the tray of the present invention, it is preferable that the tray has the same rectangular shape as the bottom surface of the heating chamber.

According to an embodiment of the supporting means of the present invention, the supporting means comprises a frame positioned below the tray, and a plurality of rollers rotatably mounted on the frame and interposed between the tray and the bottom surface of the heating chamber, and the tray is supported by the rollers to linearly reciprocate the tray.

According to another embodiment of the supporting means of the present invention, the supporting means comprises a plurality of rollers rotatably supported on and protruded upwardly from the bottom surface of the heating chamber so that the rollers can support the bottom surface of the tray.

According to an embodiment of the heating chamber of the present invention, the bottom surface of the heating chamber is formed with a depressed portion corresponding to a range that the tray is linearly reciprocated in the right and left direction.

According to another embodiment of the tray of the present invention, a protrusion for preventing the rollers from running off therefrom are formed on a circumferential portion on the bottom surface of the tray that the rollers come into contact with.

According to the present invention, even though the tray mounted within the heating chamber of the microwave oven occupies larger space within the heating chamber, the microwave can be sufficiently and uniformly irradiated or applied onto the foodstuff by means of a predetermined motion of the tray. Therefore, first of all, the foodstuff can be uniformly heated by the microwave. Further, it is expected that the space within the heating chamber of the microwave oven can be efficiently used.

DETAILED DESCRIPTION OF THE INVENTION

Hereinafter, preferred embodiments of a device for linearly moving a tray in a microwave oven according to the present invention will be explained with reference to the accompanying drawings.

Figure 1:
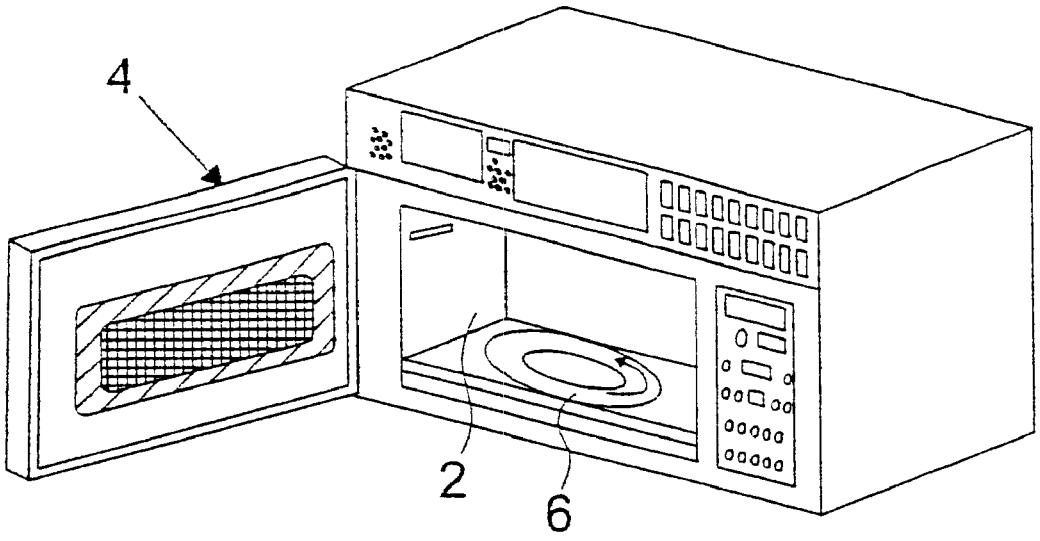
FIG. 1 PRIOR ART
FIG. 1 is a perspective view showing the constitution within a heating chamber of a conventional microwave oven.
Figure 2:
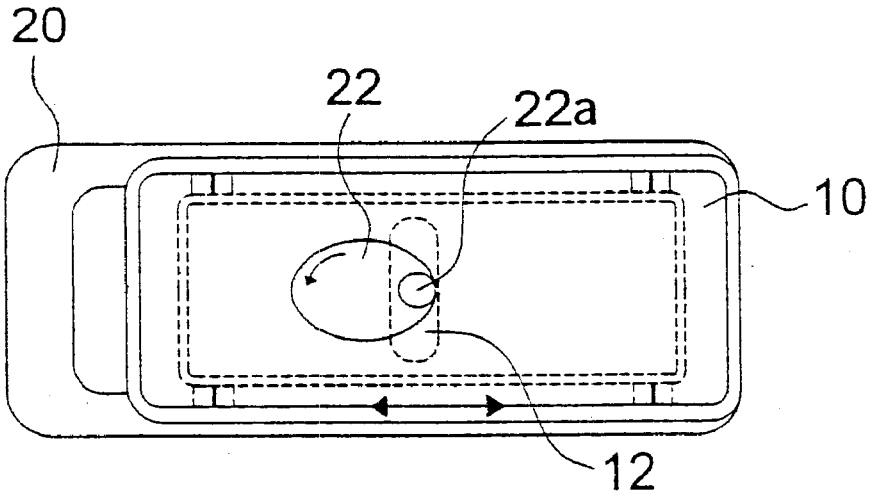
FIG. 2 is a schematic plan view of a device for linearly moving a tray in a microwave oven according to the present invention.

FIG. 2 shows a technical concept of linear motion of a tray in a microwave oven according to the present invention. The shown tray 10 is generally rectangular in shape. It can be seen that this shape of the tray corresponds to that of a bottom surface 20 of a heating chamber of the microwave oven. Thus, according to the spirit of the present invention in which the tray is linearly reciprocated in the right and left direction and within a predetermined range, the space within the heating chamber can be efficiently used by forming the tray 10 in the shape of rectangle.

Therefore, as compared with a tray of a conventional microwave oven, the tray 10 of the present invention can occupy a substantially relatively larger space within the heating chamber, which means that more foodstuffs can be loaded on a top surface of the tray 10. Accordingly, it can be seen that the space within the heating chamber can be efficiently used.

According to the present invention, the tray 10 goes through a linear reciprocating motion in the right and left direction, instead of a rotational motion of the tray of the conventional microwave oven, as indicated by an arrow in the figure. Thus, by going through the linear reciprocating motion, when a microwave having a constant wavelength supplied to the interior of the heating chamber is irradiated onto the foodstuff, the microwave will be more uniformly irradiated onto the foodstuff, thereby uniformly heating the foodstuff as a whole. That is, according to the present invention, in order to uniformly irradiate the microwave onto the foodstuff, uniform heating which is an essential requirement at a time of heating in the microwave oven can be achieved by linearly reciprocating the tray in the right and left direction.

Figure 3:
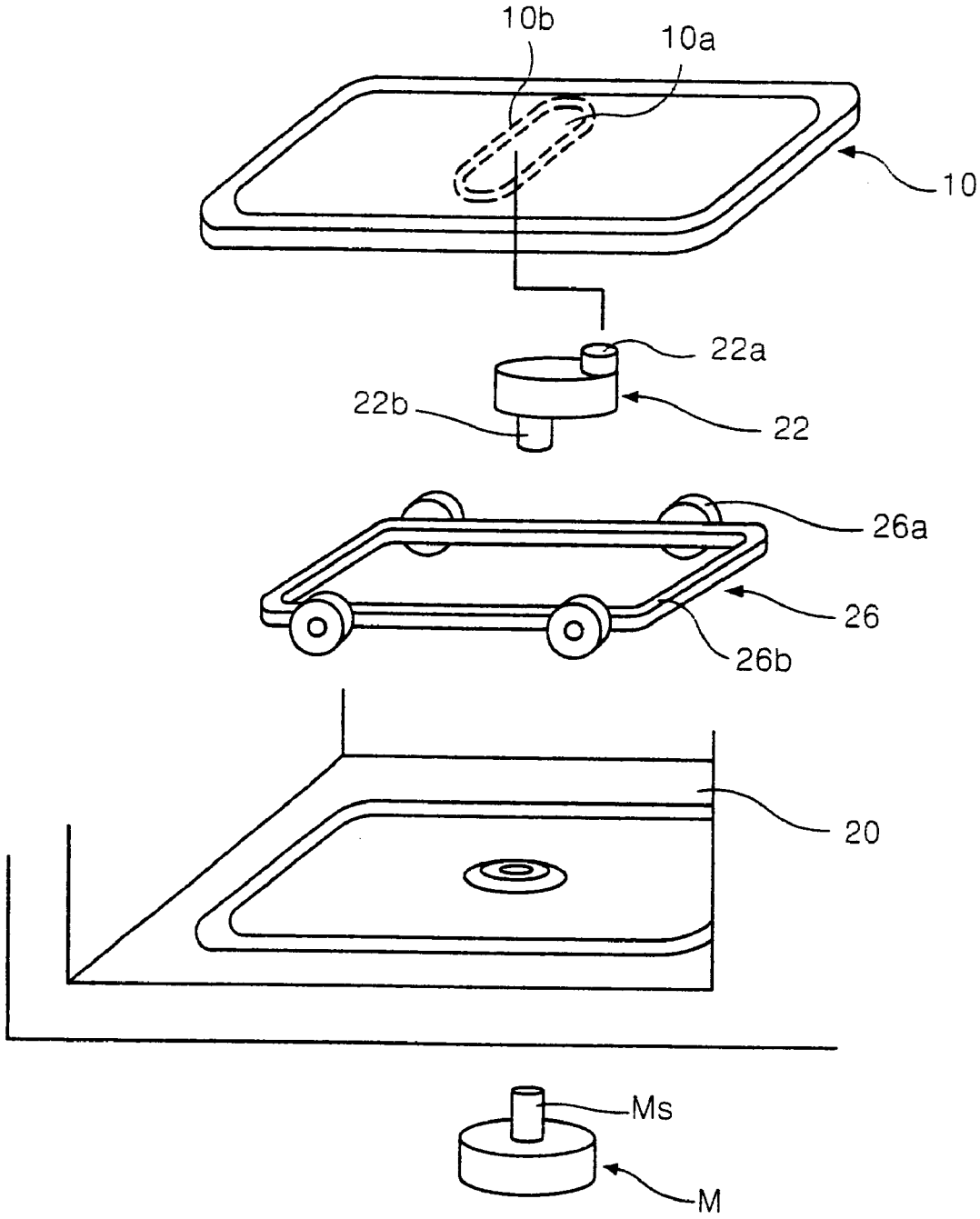
FIG. 3 is an exploded perspective view of the device according to the present invention.
Figure 4:
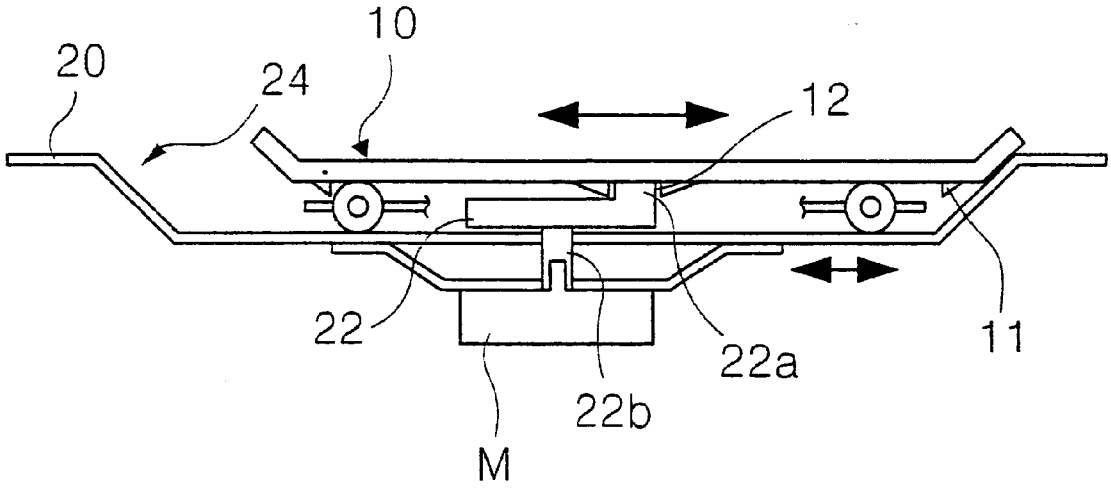
FIG. 4 is a sectional view of the device according to the present invention.

A specific constitution for performing the linear reciprocating motion of the tray in the right and left direction will be explained with reference to FIGS. 3 and 4, which are perspective and sectional views of the device for moving the tray in the microwave oven according to the present invention, respectively.

As shown in these figures, according to the present invention, a groove 10*a* having a predetermined length in the fore and aft direction is formed on a bottom surface of the tray 10. This groove 10*a* may be integrally formed with the tray 10, or separately formed by using a separate member. In the illustrated embodiment, the groove 10*a* is formed at the center of the bottom surface of the tray 10 by a circumferential portion 10*b* formed on the bottom surface of the tray 10. The groove 10*a* is formed to have a fore and aft length slightly longer than the range of the linear reciprocating motion of the tray.

An eccentric protrusion 22*a* formed on a top surface of a rotating member 22 is inserted into the groove 10*a* formed on the bottom surface of the tray 10. The rotating member 22 is constructed to be rotatably coupled with an output shaft Ms of a motor M. In the illustrated embodiment, the output shaft Ms of the motor M is inserted into and fixed to a linking shaft 22*b* formed at the center of a bottom surface of the rotating member 22 so as to transmit a rotational motion of the motor M to the rotating member 22. The eccentric protrusion 22*a* should be formed at an eccentric position radially spaced from the center of the top surface of the rotating member 22 by a predetermined distance. Accordingly, a stroke of the linear reciprocating motion of the tray 10 is substantially determined by the amount of eccentricity of the eccentric protrusion 22*a*.

The eccentric protrusion 22*a* should be inserted into the groove 10*a* with a slight play. When inserted into the groove 10*a*, the eccentric protrusion 22*a* can linearly reciprocate the tray 10 in the right and left direction as the rotating member 22 is rotated. That is, when the rotating member 22 is rotated, the eccentric protrusion 22*a* disposed at the eccentric position is also rotated. At this time, the eccentric protrusion 22*a* is moved along a predetermined circle due to the eccentricity, and the tray 10 is moved in the right and left direction within the movable distance thereof during the circular motion of the eccentric protrusion 22*a*. At this time, since the groove 10*a* is formed in the fore and aft direction, the eccentric protrusion 22*a* inserted into the groove 10*a* of the tray 10 cannot apply any force to the tray 10 in the fore and aft direction. Accordingly, the tray 10 is substantially moved only in the right and left direction.

When the tray 10 is linearly reciprocated in the right and left direction, the amount of movement of the tray 10 substantially depends on the amount of eccentricity of the eccentric protrusion 22*a*. That is, the tray 10 is linearly reciprocated in the right and left direction by a distance that is two times as large as the amount of eccentricity of the eccentric protrusion 22*a*.

A roller assembly 26 for supporting and guiding the tray 10 is interposed between the bottom surface 20 of the heating chamber and the tray 10 so as to linearly reciprocate the tray. For example, the roller assembly 26 comprises a rectangular frame 26*b* and a plurality of rollers 26*a* rotatably mounted on the rectangular frame. The rollers 26*a* serve to support the tray 10 so as to linearly reciprocate the tray 10 with respect to the bottom surface 20 of the heating chamber. That is, top surfaces of the rollers 26*a* come into contact with the tray 10, while bottom surfaces of the rollers 26*a* come into contact with the bottom surface 20 of the heating chamber. Then, when the tray 10 is linearly moved, the rollers 26*a* supports and guides the tray 10 to linearly move the tray 10 in the right and left direction.

In order to prevent the rollers 26*a* from running off their tracks and stably guide the tray 10 under the linear reciprocating motion thereof when the tray 10 is linearly reciprocated, a protrusion 11 is formed with a rectangular circumferential portion on the bottom surface of the tray 10. That is, the protrusion 11 is formed to protrude along the circumferential portion from the bottom surface of the tray. Since the rollers 26*a* always come into contact with the bottom surface of the tray 10 within the protrusion 11, the protrusion 11 serves to guide the tray 10 so as to prevent the tray 10 from running off its predetermined linear reciprocating track.

Further, the driving motor M is mounted below the bottom surface 20 of the heating chamber, and its output shaft Ms protrudes through the bottom surface 20 and is coupled with the linking shaft 22*b* of the rotating member 22. Thus, when the motor M is driven, rotational force from the motor M is transmitted to the rotating member 22 via the linking shaft 22*b* so that the rotating member 22 can be rotated.

According to the present invention, a rectangular depressed portion 24 is formed on the bottom surface 20 of the heating chamber. The depressed portion 24 substantially has the same shape as the bottom surface 20 of the rectangular heating chamber and the rectangular tray 10, and is formed to be indented as viewed in a sectional view. The depressed portion 24 is sized to receive the tray 10. Its fore and aft width is slightly larger than that of the tray 10, and its right and left width is also slightly larger than the stroke of the tray 10 in the right and left direction. Accordingly, the tray 10 that goes through the linear reciprocating motion in the right and left direction is substantially moved within the depressed portion 24 in the right and left direction. Further, it can be seen that the depressed portion 24 is configured to stably guide the tray 10 under the linear reciprocating motion thereof in the right and left direction and to prevent the tray 10 from running off its track.

Next, the overall operation of the device for linearly moving the tray in the microwave oven according to the present invention, constructed as such, will be explained.

When the microwave oven is operated with the foodstuff to be heated loaded on the top surface of the tray 10, the microwave is supplied to the interior of the heating chamber, and the tray 10 simultaneously goes through the linear reciprocating motion in the right and left direction.

As soon as the microwave oven is operated, the driving motor M is driven. The rotational force from the motor M is transmitted from the output shaft Ms of the motor M via the shaft 22*b* to the rotating member 22 so as to rotate the rotating member 22. Since the eccentric protrusion 22*a* of the rotating member 22 is inserted into the groove 10*a* formed on the bottom surface of the tray 10 with a slight play, the rotational motion of the rotating member 22 is converted into the linear reciprocating motion of the tray 10.

The length of the groove 10*a* should be designed to be slightly over two times as large as the amount of eccentricity of the eccentric protrusion 22*a*. That is, since the eccentric protrusion 22*a* should be designed to be reciprocated within the groove 10*a* in the fore and aft direction when the eccentric protrusion 22*a* is rotated, it is apparent that no interference between the eccentric protrusion 22*a* and the groove 10*a* should be generated.

Therefore, according to the present invention, while the tray 10 goes through the linear reciprocating motion in the right and left direction within the heating chamber, the microwave can be uniformly irradiated onto the foodstuff loaded on the top surface of the tray so that the foodstuff can be uniformly heated.

It can be understood that the spirit of the present invention is to linearly reciprocate the tray 10 by converting the rotational force from the driving motor M into the linear reciprocating motion of the tray 10.

In the illustrated embodiment, it can be seen that a combination of the rotating member 22 including the eccentric protrusion 22*a* and the groove 10*a* into which the eccentric protrusion 22*a* is inserted has been described as an example of a converting mechanism for converting the rotational force from the driving motor M into the linear reciprocating motion of the tray 1O.

However, the present invention is not limited to the above embodiment, but the converting mechanism for converting the rotational force from the driving motor M into the linear reciprocating motion of the tray 10 may be variously modified. In addition, many other mechanical constitutions such as a converting mechanism using a cam or a combination of cranks for implementing an articulation motion may be used for performing the linear reciprocating motion.

A separate guide may be further provided for supporting the tray 10, on which the foodstuff is loaded, so as to linearly reciprocate the tray 10 with respect to the bottom surface 20 of the heating chamber. That is, by installing any structure or mechanism capable of guiding the tray within the heating chamber so as to linearly reciprocate the tray 10 when the tray 10 is linearly reciprocated by means of the aforementioned converting means (the converting means for converting the rotational force from the driving motor M into the linear reciprocating motion of the tray 10), the tray 10 can be more safely guided to linearly reciprocate the tray 10.

Various modifications may be made to the roller assembly 26 mounted between the tray 10 and the bottom surface 20 of the heating chamber for linearly reciprocating the tray 10. Further, the frame 26*b* can be variously modified in its shape, for example. Furthermore, the rollers 26*a* can be variously modified in their positions and shapes.

Figure 5:
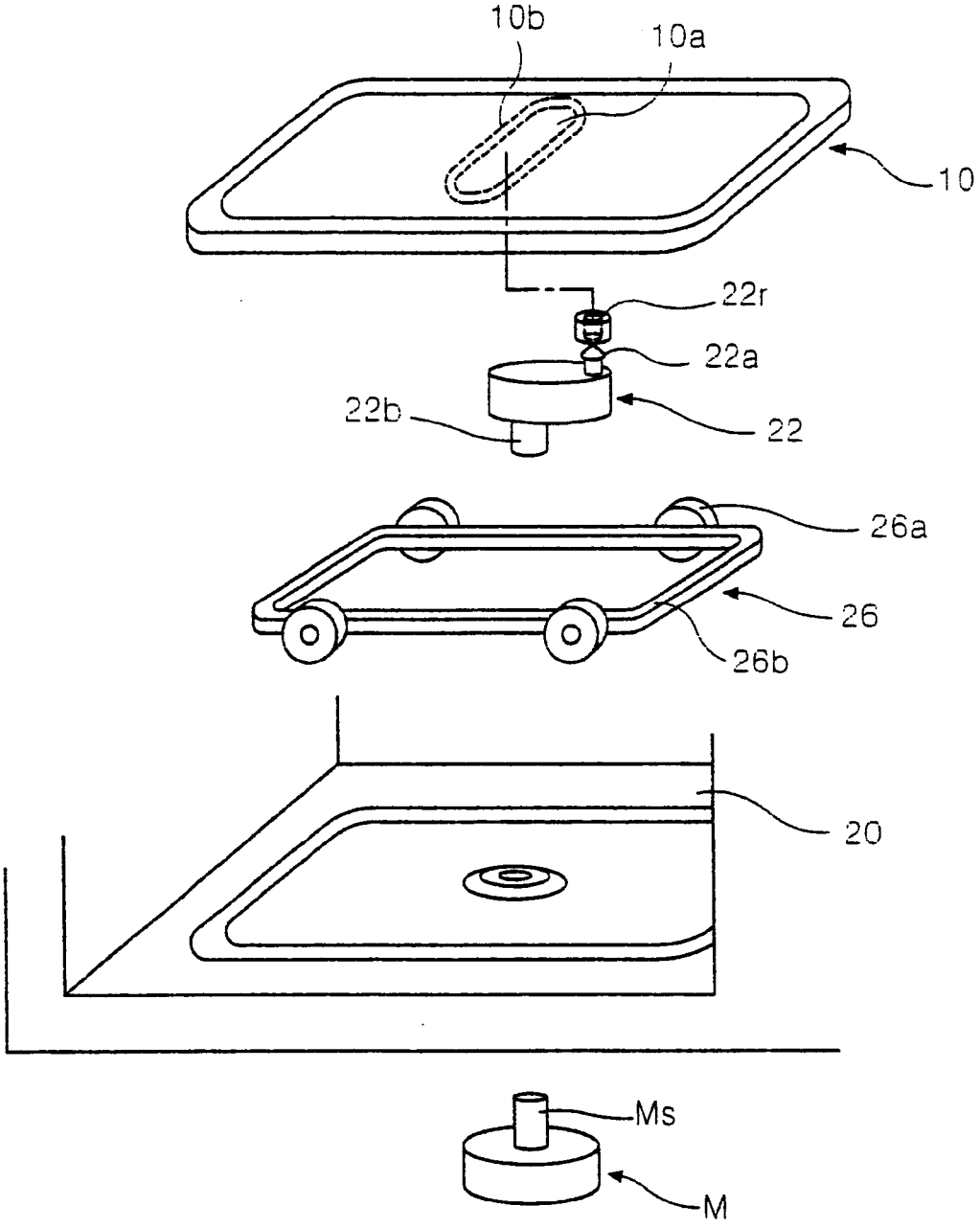
FIG. 5 is an exploded perspective view of another embodiment of the device according to the present invention.

Next, another embodiment of the device of the present invention will be explained with reference to FIG. 5. In this embodiment, the eccentric protrusion 22*a,* which is inserted into the groove 10*a* formed on the bottom surface of the tray 10 in the fore and aft direction, is constructed to be smoothly reciprocated within the groove 10*a*.

As shown, a bearing member 22*r,* which is rotatably fitted around the eccentric protrusion 22*a* formed on the top surface of the rotating member 22, is inserted into the groove 10*a* formed on the bottom surface of the tray 10. The bearing member 22*r* is rotatably fitted around the eccentric protrusion 22*a* of the rotating member 22 and is smoothly rotated with respect to the protrusion. Further, the bearing member 22*r* may be formed of, for example, a roller rotatably fitted around the eccentric protrusion 22*a*. As long as they are rotatably fitted around the eccentric protrusion 22*a,* any types of bearings can be used.

When it is rotated while being inserted into the groove 10*a,* the bearing member 22*r* can serve to smoothly reciprocate the tray 10.

In this embodiment, the bearing member 22*r* is rotated in contact with at least one side of the eccentric protrusion 22*a* and the groove 10*a* when it is inserted into the groove 10*a* of the bottom surface of the tray 10. That is, the bearing member 22*r* is inserted into the groove 10*a* and simultaneously fitted around the eccentric protrusion 22*a*. In order to linearly move the tray 10 while the eccentric protrusion 22*a* is rotated, the bearing member 22*r* should be rotated in a state that the bearing member comes into contact with both the groove 10*a* and the eccentric protrusion 22*a*. When the bearing member 22*r* is rotated in contact with both the inner surface of the groove 10*a* and the eccentric protrusion 22*a,* it is most preferable that frictional force between the bearing member 22*r* and at least one side of the inner surface of the groove 10*a* and the eccentric protrusion 22*a* be minimized, and that rolling motions therebetween be produced.

Accordingly, in this embodiment, any types of bearings can be used as the bearing member 22*r*. For example, a ball bearing with a plurality of balls contained therein can be used. In addition, by constructing the bearing member such that it can come into contact with the eccentric protrusion 22*a* and the groove 10*a* with sufficient lubricant filled therebetween, the bearing member can be smoothly moved therebetween.

Further, the bearing member 22*r* should be inserted into the groove 10*a* with a slight play. When inserted into the groove 10*a,* the bearing member 22*r* can linearly reciprocate the tray 10 in the right and left direction as the rotating member 22 is rotated. When the tray 10 is linearly reciprocated in the right and left direction, the amount of movement of the tray 10 substantially depends on the amount of eccentricity of the eccentric protrusion 22*a.* That is, as described above, the tray 10 is linearly reciprocated in the right and left direction by a distance that is two times as large as the amount of eccentricity of the eccentric protrusion 22*a* with respect to the rotational center of the rotating member 22.

As described above, according to this embodiment, since the bearing member 22*r* fitted around the eccentric protrusion 22*a* is rotated in rolling contact with the inner surface of the groove 10*a,* the tray 10 can be more smoothly reciprocated in the right and left direction.

Since the constitution except for the bearing member 22*r* is substantially the same as the first embodiment, the detailed description thereof will be omitted.

Figure 6:
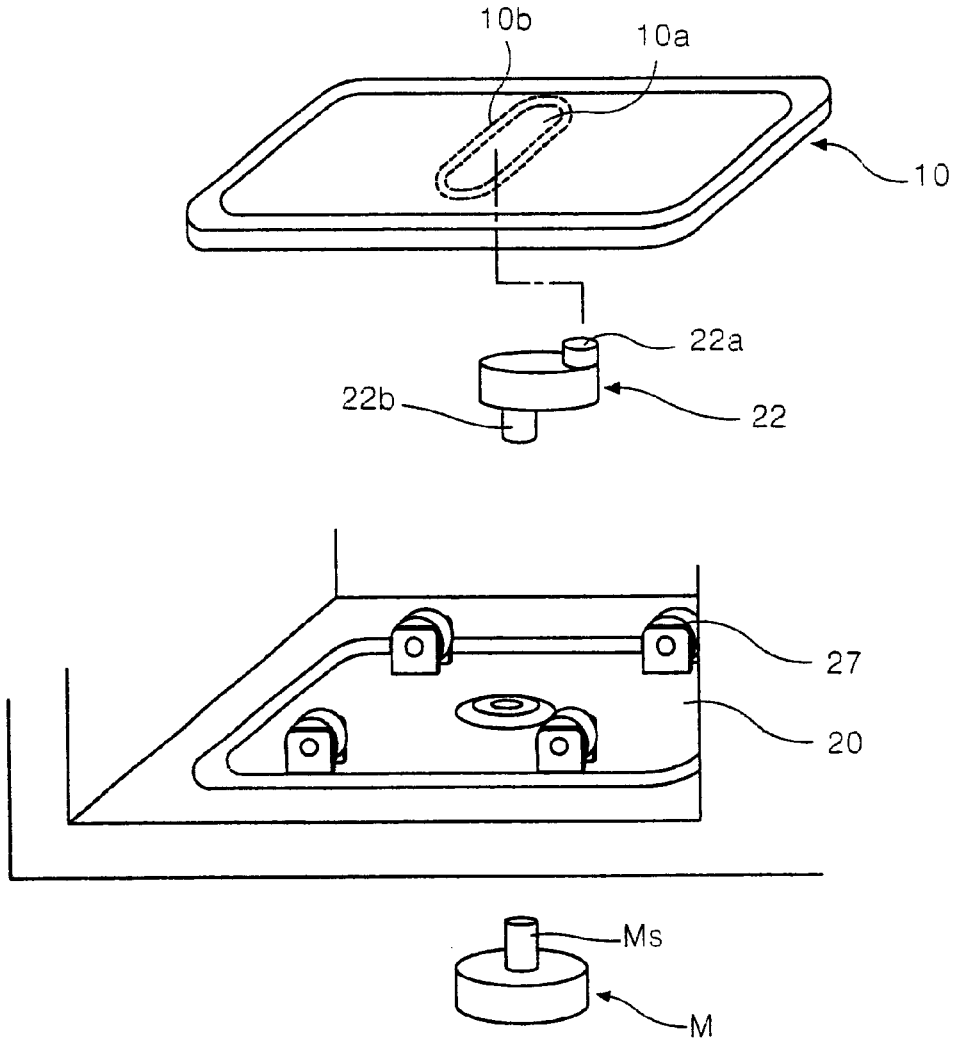
FIG. 6 is an exploded perspective view of a further embodiment of the device according to the present invention.
Figure 7:
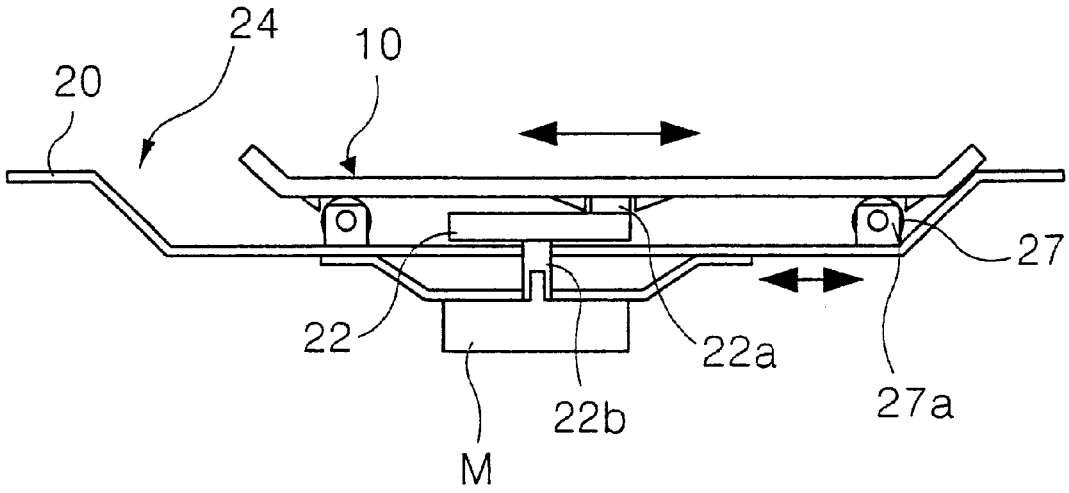
FIG. 7 is a sectional view of the above further embodiment of the device according to the present invention.

Next, a further embodiment of the device of the present invention will be explained with reference to FIGS. 6 and 7. In this embodiment, a plurality of rollers 27 is directly mounted on the bottom surface 20 of the heating chamber, instead of the roller assembly 26 in the first embodiment.

As shown in these figures, according to this embodiment, the plurality of rollers 27 is mounted on the bottom surface 20 of the heating chamber. The rollers 27 is a member for allowing the tray 10 to come into rolling contact therewith in a state that the bottom surface of the tray 10 does not come into contact with the bottom surface 20 of the heating chamber, when the tray 10 is linearly reciprocated in the right and left direction. Accordingly, the rollers 27 are mounted within the depressed portion 24 so as to be rotatable in a direction corresponding to the linear reciprocating direction of the tray 10. Further, in order to more stably support the tray 10, the rollers 27 consists of four rollers as shown in FIG. 6.

In the illustrated embodiment, the rollers 27 are also rotatably supported by a plurality of supporting brackets 27*a.* The supporting brackets 27*a* may be either formed integrally with the bottom surface 20 of the heating chamber or attached to the bottom surface 20 of the heating chamber after they have been formed as separate members. In this embodiment, it is sufficient that the rollers 27 are constructed such that it can protrude upwardly from the bottom surface 20 of the heating chamber and its top surface can support the tray 10 while contacting with the bottom surface of the tray 10.

In this embodiment, a set of the rollers 27 corresponds to the roller assembly 26 in the first embodiment, and serves to stably support the tray 10 which goes through the linear reciprocating motion substantially in the right and left direction.

As explained above, according to the present invention, an essential requirement that the foodstuff to be heated by the microwave can be uniformly heated is not only satisfied, but also the space within the heating chamber can be efficiently used, since the space within the heating chamber usable by the tray in the microwave oven according to the present invention is larger than that of the conventional microwave oven. Furthermore, according to the present invention, there is an advantage in that more foodstuffs can be heated, in use, compared with the conventional microwave oven having substantially the same capacity.

It will be understood by those skilled in the art that various changes and modifications may be made to the present invention without departing from the spirit and scope of the present invention. It is apparent that the scope of the present invention should be construed only by the accompanying claims.

What is claimed is:

1. A device for linearly moving a tray in a microwave oven having a heating chamber for heating an item, comprising:

a tray for loading thereon an item to be heated within the heating chamber;

a driving motor for generating rotational force;

a converting means for converting a rotational motion from the driving motor into a linear reciprocating motion of the tray; and a supporting means mounted between a bottom surface of the heating chamber and the tray for supporting the tray so as to linearly reciprocate the tray, wherein the converting means comprises a rotating member connected to the driving motor, a groove formed in the tray, and an eccentric protrusion formed on the rotating member and in communication with said groove.

2. The device as claimed in claim 1, wherein the groove is formed in a bottom surface of the tray and has a predetermined length in the fore and aft direction, and the eccentric protrusion is formed at an eccentric position and inserted into the groove, and the rotating member is rotated by the driving motor so that the tray can be linearly reciprocated in the right and left direction depending on the amount of rotation of the eccentric protrusion.

3. The device as claimed in claim 2, further comprising a bearing member fitted around the eccentric protrusion for coming into rolling contact with an inner wall of the groove.

4. The device as claimed in claim 1, wherein the tray has the same rectangular shape as the bottom surface of the heating chamber.

5. The device as claimed in claim 1, wherein the supporting means comprises a frame positioned below the tray, and a plurality of rollers rotatably mounted on the frame and interposed between the tray and the bottom surface of the heating chamber, and the tray is supported by the rollers to linearly reciprocate the tray.

6. The device as claimed in claim 5, wherein a protrusion for preventing the rollers from running off therefrom are formed on a circumferential portion on the bottom surface of the tray that the rollers come into contact with.

7. The device as claimed in claim 1, wherein the supporting means comprises a plurality of rollers rotatably supported on and protruded upwardly from the bottom surface of the heating chamber so that the rollers can support the bottom surface of the tray.

8. The device as claimed in claim 1, wherein the bottom surface of the heating chamber is formed with a depressed portion corresponding to a range that the tray is linearly reciprocated in the right and left direction.

9. The device as claimed in claim 1, further comprising a bearing interposed between said groove and said eccentric protrusion.

10. The device as claimed in claim 9, wherein the bearing is in the shape of a roller rotatably fitted around the eccentric protrusion.

11. A device for linearly moving a tray in a microwave oven with a hexahedral heating chamber for heating an item included therein, comprising:

a tray for loading thereon an item to be heated within the heating chamber;

a driving motor for generating rotational force;

a converting means for converting a rotational motion from the driving motor into a linear reciprocating motion of the tray; and a supporting means mounted between a bottom surface of the heating chamber and the tray for supporting the tray so as to linearly reciprocate the tray, wherein the converting means comprises a groove formed in the bottom surface of the tray and having a predetermined length in the fore and aft direction, and a rotating member with an eccentric protrusion formed at an eccentric position and inserted into the groove, and the rotating member is rotated by the driving motor so that the tray can be linearly reciprocated in the right and left direction depending on the amount of rotation of the eccentric protrusion.

12. The device as claimed in claim 11, further comprising a bearing member fitted around the eccentric protrusion for coming into rolling contact with an inner wall of the groove.

13. The device as claimed in claim 11, wherein the tray has the same rectangular shape as the bottom surface of the heating chamber.

14. The device as claimed in claim 11, wherein the supporting means comprises a frame positioned below the tray, and a plurality of rollers rotatably mounted on the frame and interposed between the tray and the bottom surface of the heating chamber, and the tray is supported by the rollers to linearly reciprocate the tray.

15. The device as claimed in claim 14, wherein a protrusion for preventing the rollers from running off therefrom are formed on a circumferential portion on the bottom surface of the tray that the rollers come into contact with.

16. The device as claimed in claim 11, wherein the supporting means comprises a plurality of rollers rotatably supported on and protruded upwardly from the bottom surface of the heating chamber so that the rollers can support the bottom surface of the tray.

17. The device as claimed in claim 11, wherein the bottom surface of the heating chamber is formed with a depressed portion corresponding to a range that the tray is linearly reciprocated in the right and left direction.

18. The device as claimed in claim 11, further comprising a bearing interposed between said groove and said eccentric protrusion.

19. The device as claimed in claim 18, wherein the bearing is in the shape of a roller rotatably fitted around the eccentric protrusion.

20. A microwave oven having a heating chamber for heating an item, comprising:

a tray for loading thereon an item to be heated within the heating chamber;

a driving motor for generating rotational force;

a converting means for converting a rotational motion from the driving motor into a linear reciprocating motion of the tray; and a supporting means mounted between a bottom surface of the heating chamber and the tray for supporting the tray so as to linearly reciprocate the tray, wherein the converting means comprises a rotating member connected to the driving motor, a groove formed in the tray, and an eccentric protrusion formed on the rotating member and in communication with said groove.

21. A microwave oven having a heating chamber, wherein the improvement comprises a tray for loading thereon an item to be heated within the heating chamber;

a driving motor for generating rotational force; and a linking member configured to link the driving motor to the tray, wherein the tray includes a mechanism configured to convert rotational force of the driving motor into a linear movement of the tray.

22. The microwave oven as claimed in claim 21, wherein the mechanism comprises a groove formed in the tray.

23. The microwave oven as claimed in claim 21, further comprising rollers positioned between a bottom surface of the heating chamber and the tray, wherein the rollers are fixed to the bottom surface of the heating chamber.

24. The microwave oven as claimed in claim 21, further comprising a frame having rollers attached thereto positioned between a bottom surface of the heating chamber and the tray.

25. The microwave oven as claimed in claim 24, further comprising a protrusion formed on the bottom surface of the heating chamber and configured to prevent the rollers from running off therefrom.

* * * * *